US006402081B1

(12) United States Patent
Rautakorpi et al.

(10) Patent No.: US 6,402,081 B1
(45) Date of Patent: Jun. 11, 2002

(54) METHOD FOR STOPPING A MACHINE REEL

(75) Inventors: Timo Rautakorpi, Espoo; Petri Enwald, Tuusula, both of (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/581,784

(22) PCT Filed: Oct. 15, 1999

(86) PCT No.: PCT/FI99/00852

§ 371 (c)(1),
(2), (4) Date: Jun. 16, 2000

(87) PCT Pub. No.: WO00/23365

PCT Pub. Date: Apr. 27, 2000

(30) Foreign Application Priority Data

Oct. 16, 1998 (FI) ..... 982248

(51) Int. Cl.[7] ..... B65H 18/08

(52) U.S. Cl. ..... 242/534; 242/541.5; 242/541.6; 242/542.3

(58) Field of Search ..... 242/534, 541.1, 242/541.5, 541.6, 542.2, 542.3

(56) References Cited

U.S. PATENT DOCUMENTS

| | | | | |
|---|---|---|---|---|
| 3,258,217 A | * | 6/1966 | MacArthur et al. | |
| 3,471,097 A | | 10/1969 | Phelps | |
| 3,957,221 A | | 5/1976 | Palovaara | |
| 4,356,983 A | | 11/1982 | Weiss | |
| 4,744,526 A | * | 5/1988 | Kremar | |
| 4,944,467 A | | 7/1990 | Snygg | |
| 4,964,587 A | * | 10/1990 | Oki et al. | |
| 5,375,790 A | * | 12/1994 | Svanqvist | 242/541.1 |
| 5,690,298 A | | 11/1997 | Rück | 242/542.3 |
| 5,816,528 A | * | 10/1998 | Ekstrom et al. | 242/541.5 |
| 5,895,007 A | * | 4/1999 | Moller et al. | 242/541.5 X |
| 5,918,830 A | * | 7/1999 | Verajankorva et al. | 242/541.1 |
| 5,967,449 A | * | 10/1999 | Thomas et al. | 242/541.1 |
| 5,988,557 A | * | 11/1999 | Moller et al. | 242/541.1 X |

FOREIGN PATENT DOCUMENTS

| | | |
|---|---|---|
| DE | 29604401 | 7/1996 |
| EP | 0483092 | 4/1992 |
| EP | 0658504 | 6/1995 |
| WO | 9534495 | 12/1995 |

* cited by examiner

*Primary Examiner*—William A. Rivera
(74) *Attorney, Agent, or Firm*—Steinberg & Raskin, P.C.

(57) ABSTRACT

In the method for stopping a machine reel (R) in the final stage of reeling a web (W), the web (W) is cut when the machine reel (R) has become full, the web (W) is possibly guided on a new reeling shaft (2), and the rotation of the machine reel (R) detached from the nip contact with a reeling cylinder (1) is stopped by means of braking forces which are exerted both on the reeling shaft (2) of the full machine reel (R) and on the surface of the machine reel (R). The braking powers which are exerted on the reeling shaft (2) of the machine reel (R) and on the surface of the machine reel (R) and which stop the machine reel (R) are distributed in the ratio (S) of 1:1 . . . 100:1. The ratio can be changed during the deceleration of the machine reel.

21 Claims, 3 Drawing Sheets

METHOD FOR STOPPING A MACHINE REEL

FIELD OF THE INVENTION

Figure 1:
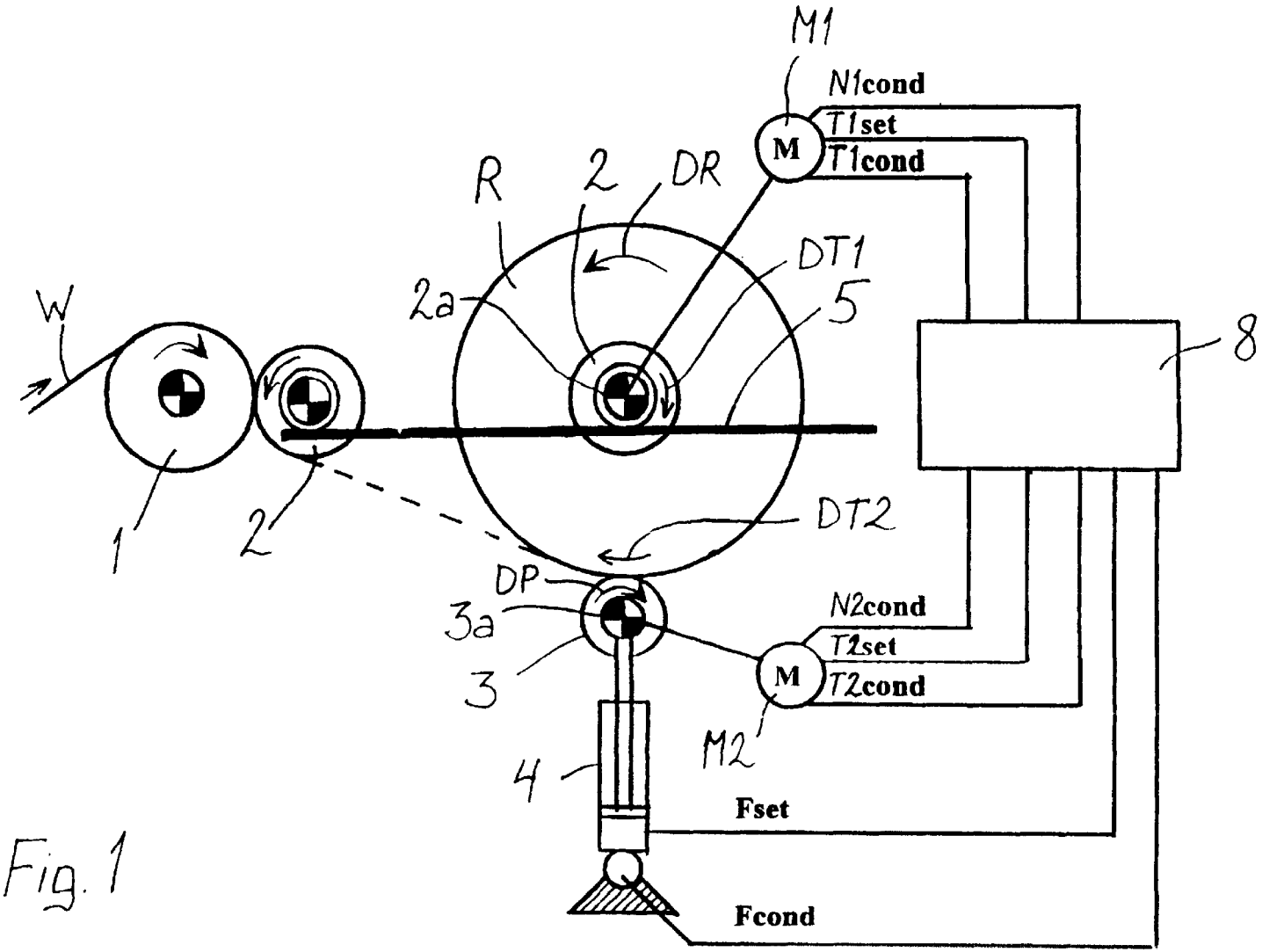

The invention relates to a method for stopping a machine reel in a paper machine in the final stage of reeling a web, wherein after the reel change, stopping braking forces are exerted on the centre-drive and on the surface of a rotating machine reel detached from the reeling cylinder. Hereinbelow, a shorter term "reel" will be used for the machine reel.

BACKGROUND OF THE INVENTION

It is a known procedure to stop the reel by means of a braking force which is exerted exclusively on the centre-drive, i.e. is effective from the shaft of the reel, and which is opposite to the direction of rotation of the reel spool. The method is applicable especially in situations where a large amount of time has to be used or can be used for stopping. The amount of time to be used is primarily affected by the efficiency requirements of the paper machine and on the other hand by the dimensioning of the space to be used in the change situation, in other words how well and how long the new reel to be stopped and the new reel that is becoming full simultaneously fit in the reel-up, e.g. on the same reeling rails.

Especially along with the growing efficiency requirements, it has become necessary to shorten the stopping time, which easily causes considerable problems when stopping is conducted only by means of a braking force effective from the shaft. Especially in case of slippery paper grades, the act of increasing the braking force to accelerate the stopping causes so-called creeping i.e. "unrolling" of the surface layers of the reel, because some surface layers tend to continue their movement in the direction of rotation, i.e. the direction of unrolling of the reel, at the original speed of rotation, irrespective of the decreasing speed of rotation of the inner layers, which results in that the reel is slackened. The slackening takes place on the outer perimeter because the unrolling of the spiral structure of the reel is first possible therein, and, on the other hand, the largest mass and the largest diameter i.e. the largest inertia momentum, is present on the outer perimeter. The unrolled surface section of the reel is unfit for use and causes broke. In an on-line coating and calendering line, the need to discharge broke can grow as high as 2500 meters.

To eliminate the above-described problem, there are known solutions which are based only on the use of braking force exerted on the surface of the reel, and solutions which are based on the use of two separate braking forces simultaneously, i.e. a braking force effective from the shaft and a braking force exerted on the surface of the reel, thus being effective through the surface.

Force effects which are exerted especially and/or solely on the surface of the reel are presented for example in the publications EP-483 092, EP-658 504, U.S. Pat. No. 3,471,097 as well as in the publication FI-95683 and in the corresponding international publication WO 95/34495.

In the two first-mentioned publications, the presented embodiments include a press roll which forms a nip with the surface of the reel, and in the latter of these also a set of belts that forms a nip. In these embodiments, the purpose of the press rolls and the set of belts is primarily to prevent the access of air between the layers of paper when the machine reel is detached from the reeling cylinder and when the web is still passed on the roll, and not to affect the stopping of the roll. Furthermore, the publications do not present solutions for producing a braking force effective from the shaft.

The solution according to the patent publication U.S. Pat. No. 3,471,097 includes a set of belts which is intended to function as a part of the devices performing a so-called bag change. The purpose of the set of belts is also to decelerate the rotation of the reel and to stop it eventually. The braking force is not exerted on the reel in other ways. In the process of stopping the reel in a manner complying with the requirements of present paper machines, the sole use of such a set of belts as an actual braking member would result in an excessive loading force exerted on the surface of the reel, which could easily cause damaging of the surface layers and a growing need to discharge paper as broke, i.e. it would not be advantageous to prevent the surface layers from unrolling.

The purpose of the member disclosed in the Finnish patent publication FI-95683, exerting loadig force on the surface of the reel, is especially to prevent the access of air between the layers of paper when the web is reeled on the reel while the nip between the reel and the reeling cylinder is open. Said member can be a fragmentary roll or a spreader bar, but particularly the publication mentions a brush device by means of which especially a radial force effect is to be exerted on the surface. Even though it is possible to reduce the creeping risk of a full reel by using a brush device or the like, at the same time producing especially radial braking force, there are, however, problems related to the use of this solution with respect to stopping the reel. Even if the aim was to attain significant braking forces by means of this device, considerably large radial forces would be required because the braking force is primarily produced by means of the friction between the press contact surface of the device and the outer surface of the reel, and the friction between the paper layers. Also in this case, the use of large braking forces would easily cause unnecessary damaging of surface layers and a need to discharge paper as broke. Furthermore, because of the surface structure of the brush device, it is not possible to manufacture a practicable brush device intended for braking and stopping in particular. Similarly, it is obvious that said fragmentary roll and spreader bar are not intended for exerting significant braking forces on the reel.

German utility model DE-29604401 discloses an arrangement for braking and stopping the reel in such a way that the reel is decelerated both by means of a braking force effective from the shaft and a braking force produced on the surface of the reel, formed from a radial and peripherally directed (tangential) force, applied from outside to the perimeter of the reel. The braking force effective on the surface is produced by means of a press device, especially by means of a press roll, which is loaded against the reel to attain a radial force, and which is equipped with a drive to accelerate its speed of rotation to the peripheral speed of the reel before it is brought in contact with the reel. The press roll also includes an adjustable brake device to produce and adjust the peripheral braking force affecting the reel. This publication suggests that the braking power exerted on the surface should be greater than the braking power exerted on the shaft, wherein the braking force effective on the surface has to be increased unnecessarily high. This also requires substantially powerful devices to attain the loading effect of the press member as well as to affect the rotation. As the aim of the above-presented solution is to prevent the creeping of the surface layers, it is obvious that great braking forces effective on the surface easily damage the surface layers of the reel. This effect is even stronger if, according to the presented solution, said braking forces have to be increased along with the increased creeping risk.

OBJECTS AND SUMMARY OF THE INVENTION

It is an aim of the present invention to introduce a method for stopping a reel, by means of which method the deficiencies of the above-presented prior art solutions can be eliminated to a large extent, thus improving the state of art prevailing in the field. To attain this purpose, the method according to the invention is primarily characterized in that the braking powers which stop the reel and are exerted on the centre-drive of the reel and on the surface of the reel, i.e. braking powers which act through the shaft and through the surface, are distributed during the stopping according to the ratio of S=1:1 . . . 100:1. Thus, the braking power effective on the surface is at the most equal to the braking power effective from the shaft, and it can be reduced therefrom or changed further, if necessary, during the stopping. The range in which the ratio of the powers lies can also be 1:1 . . . 50:1, 5:4 . . . 100:1, 5:4 . . . 50:1, 3:2 . . . 100:1, 3:2 . . . 50:1, 1:1 . . . 10:1, 5:4 . . . 10:1, 3:2 . . . 10:1, 1:1 . . . 5:1, 5:4 . . . 5:1, or 3:2 . . . 5:1. The ratio can be the same, or it can be changed, preferably in such a way that the ratio remains within the above-defined range most of the braking time, for example at least 9/10 of the total braking time, or all the time when braking power is exerted on the reeling shaft and on the surface of the machine reel by means of corresponding brake devices.

By means of the method according to the invention, it is possible to minimize the stopping time of the reel and at the same time to reduce the damaging of the surface layers as well as the need to discharge paper as broke. In the method, attention is paid to the fact that the braking force effective on the surface produces a controlled stopping together with the friction forces of the paper layers, even in such a manner that the braking and stopping take place without the creeping phenomenon in the surface layers and the slackening of the reel. To implement the stopping in an optimal manner it is possible in the method to pay attention during the entire stopping process to the magnitude of all braking forces and braking torques produced as well as to the changes therein, to the weight and speed of rotation of the reel and the changes therein and to the friction properties of the paper. For example on the basis of these variables the most appropriate braking force and/or torque at a given time is changed. Because substantially smaller braking forces than those used in solutions of prior art are necessary when the method according to the invention is applied, it is possible to keep the structures and solutions in a relatively moderate level with respect to the output of the apparatus to be used.

The invention is suitable to be utilized in connection with continuously operating reel-ups in which machine reels are formed from a full-width paper web of several meters in width (e.g. 5 m or more) issuing from a paper machine or a finishing machine for paper. Growing machine speeds, machine widths and maximum diameters of the reels result in reels of large mass that rotate at high speed after the cutting of the web. These reels have to be decelerated as rapidly as before despite of the large rotational energy, or because of the time available, one has to aim at even shorter braking times. In case of a cylindrical body, which is a good approximation of the machine reel, the rotational energy is directly proportional to the mass of the body, the square of the angular speed of the body and to the square of the radius of the body. It can be proven by calculations that when the web speed (the surface speed of the reel) grows by 50%, the mass of the reel by 125% and the diameter of the reel approximately by 25%, the rotational energy grows approximately fivefold, which considerably increases the braking time when the same braking torque is used.

Other features characteristic to the method according to the invention will become apparent from the appendent dependent claims and from the description hereinbelow.

BRIEF DESCRIPTION OF THE INVENTION

Figure 2:
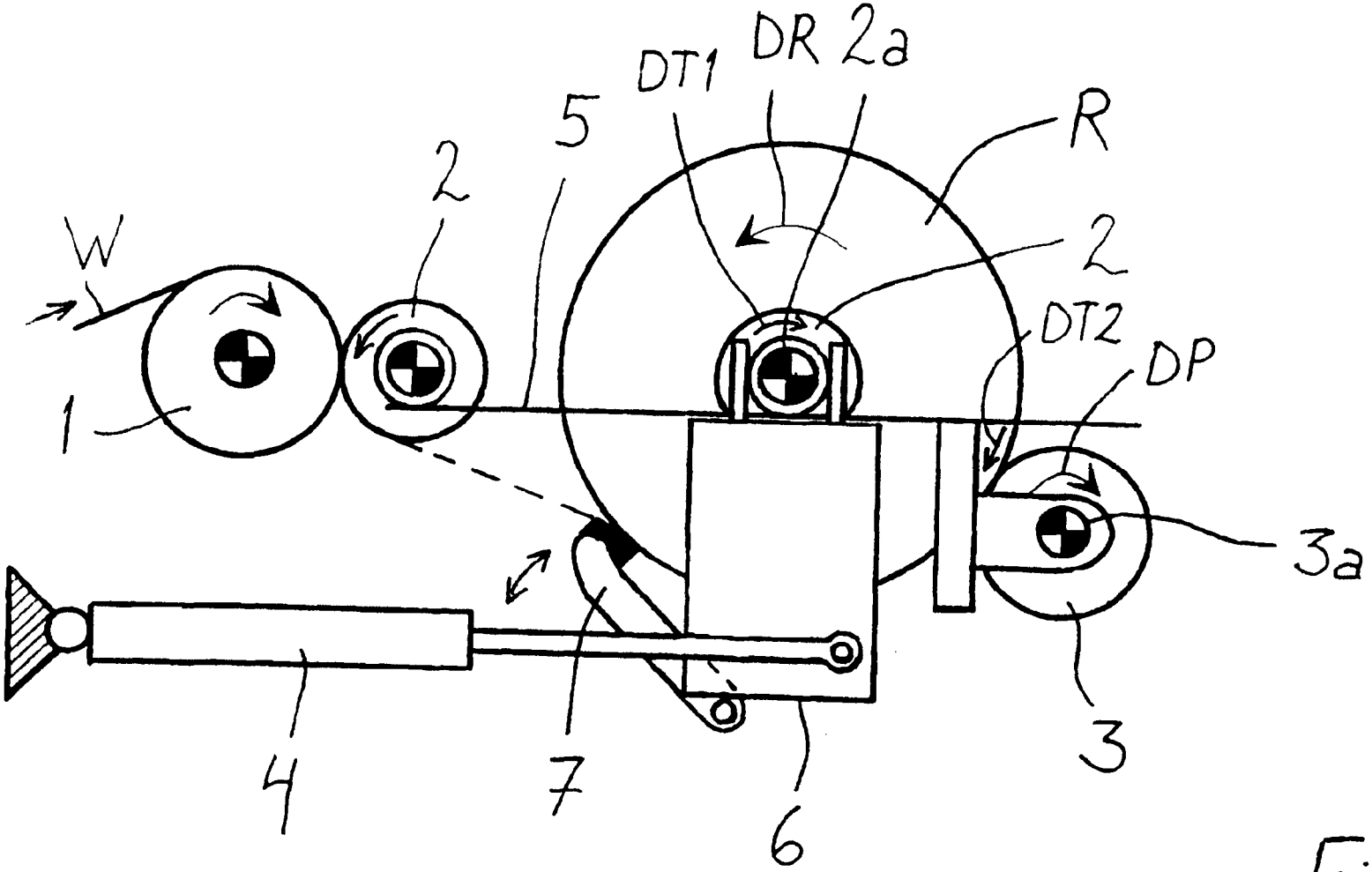
Figure 3:
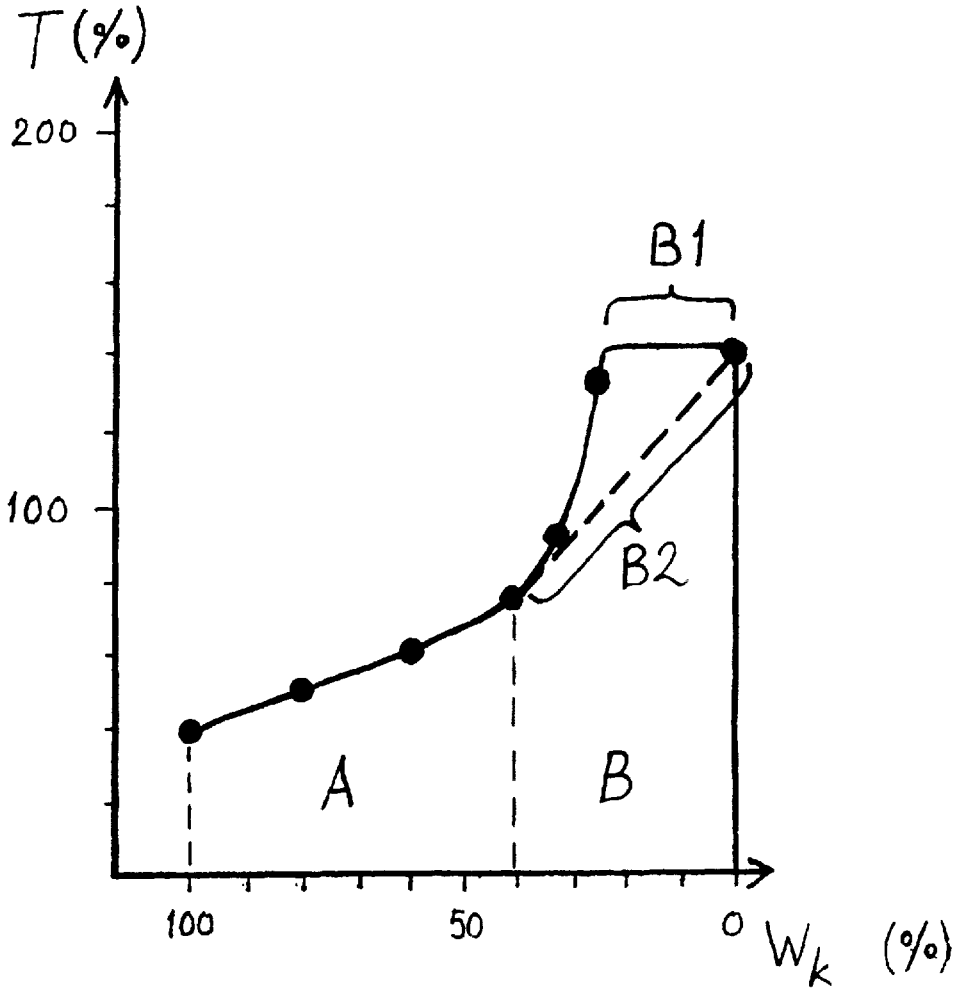
Figure 4:
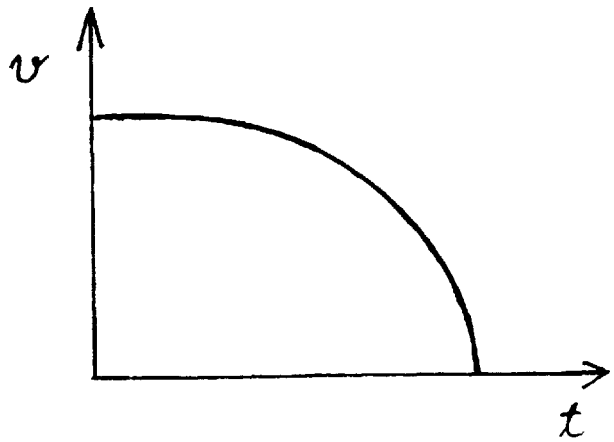

In the following, the invention will be described in more detail with reference to the appended drawing, in which FIG. 1 schematically illustrates the principle of the method, FIG. 2 shows an arrangement suitable for applying the method in a stopping station for a paper reel, FIG. 3 is an example of braking control, and FIG. 4 illustrates the deceleration of the reel under the control according to the principle of FIG. 3.

DETAILED DESCRIPTION OF THE INVENTION

FIGS. 1 and 2 show schematically a reel-up of a paper machine, a so called Pope reel-up which continuously forms paper reels from a full width web W issuing from a paper machine or the like, such as a finishing machine for paper, around reeling shafts 2*a* rotating on reeling rails 5 or corresponding supports. One paper reel that has become full is marked with the letter R. In the situation show shown in the drawings, the full reel R has already been transferred in the machine direction away from the reeling cylinder 1 to a change situation, and a new reeling shaft, i.e. a reel spool 2 has been brought in contact with the web W.

The web W itself accumulates on the reel R in the following way. The rotating reeling cylinder 1 guides the web W on the reel R, which is loaded in the radial direction against the reeling cylinder 1 on the other side of the reeling cylinder 1, as seen in the travel direction of the web W, by means of loading devices known as such, not shown in the drawing. The reel R is centre-driven, in other words the reel spool 2 around which the reel R is accumulated, is equipped with a drive. The full reel R has been transferred along the reeling rails 5, or on corresponding supports to a change station away from the reeling cylinder 1. In the travel direction of the web W before the full reel R, a new reel spool 2 forming the core of the next reel has been brought against the mantle of the reeling cylinder 1. At this stage, the web W still travels for a while on the reel R to be reeled via a nip between the new reel spool 2 and the reeling cylinder 1 and via the mantle of the reel spool 2 (broken line) until the web W is cut by means of a cutting device (not shown) known as such and guided around a new reel spool 2, and the rotation of the reel R is decelerated and stopped when it is in the change station. The invention is not, however, restricted to this change method and to the reel-up structure shown in the drawing, and it is common to all situations of stopping the reel that the stopping is conducted by exerting braking power on the reel rotating in the reel-up, which reel has been transferred away from the nip contact with the reeling cylinder 1. The web can be cut and changed on a new reel spool for example before the nip is opened.

The reel spool 2 is equipped with a centre-drive connected to its shaft 2*a* and acting thereon, to attain a braking force effective from the shaft 2*a*. When the reel R continues its rotation in the direction DR, the rotation is decelerated by means of a braking force effective in the opposite direction DT1, which produces a braking torque on the reel R via the reel spool 2.

The surface of the rotating reel R to be decelerated by the reel spool 2, advantageously its lower surface, is loaded with a press roll forming a nip with the reel R, especially to attain a radial force effective on the surface, wherein the loading force of the press roll 3 is produced by means of a loading device 4, such as a hydraulic force device or the like, connected directly to the press roll and acting on the same. The force of the loading device 4 is adjustable.

The press roll 3 is also equipped with a drive connected to its shaft 3*a* and acting on the same, for the purpose of controlling the rotation of the press roll 3 and thus the peripheral braking force effective on the surface, i.e. the brake device can be a brake generator. The direction of rotation of the press roll 3 is marked with letters DP and the braking force effected by the radial and peripheral forces and producing a braking torque on the reel R via the peripheral surface of the reel is marked with a reference sign DT2. In connection with the roll 3 it is also possible to use a mechanical or hydraulic brake device.

During the braking process, the reel R can be in the same change station into which it has been transferred after it was detached from the reeling cylinder. When the reel has been fully stopped, it is transferred away from this station for example along the rails 5 or on the support of a corresponding supporting structure bearing the ends of the reel spool 2, onwards to a point in which it will be removed from the reel-up, for example to stoppers into which the reel rolls along the rails 5 after stopping.

FIG. 2 shows an embodiment for decelerating and stopping the reel R, in which embodiment the press roll 3 is a so-called fixed-position roll, which is advantageously located behind the reel R in the travel direction of the web, for example in the frame of the reel-up. The loading force of the press roll 3 is accomplished by means of a loading device 4, such as a hydraulic force device, of a reeling carriage 6 or the like transferring the reel spool 2 and thereby the entire reel, the force produced by said loading device being adjustable. When the reel R is detached from the reeling cylinder 1, it can thus be driven directly into contact with the roll 3 to the change station along the rails 5 by means of the loading device.

In FIG. 1, the roll 3 is located relatively close to the point in which the web W enters the reel, and it can also be used for the same purpose as the brush device before cutting the web. As can be seen in FIG. 2, the roll 3 is located further away from the entrance point of the web W, and it is advantageous to place a separate press device 7, such as a brush device or the like, in the braking arrangement. This device is located before the roll 3 in the direction of rotation of the reel, and its purpose is to prevent access of air between the paper layers. The brush device can have a prior art function and structure. The brush can also be replaced by a roll as a contact member. As is well known, the force effected by this type of press device on the surface of the reel is very small and thus it is not taken into account in the study of the braking powers. Such a press device can also be used before the press roll 3 in the system of FIG. 1, especially if the press roll 3 is located after the lowest point of the reel, i.e. farther behind in the direction of rotation than in FIG. 1.

When the reel R has stopped in the change station of FIG. 2, it has to be removed directly from this station away from the reel-up, if the roll 3 cannot be moved away. However, the roll 3 can have a fixed position in that respect that it is stationary in the braking stage, but can be moved away after the reel has stopped, wherein the reel can be moved forward in the reel-up to the removal station without being obstructed by the roll.

Other parts of the embodiment of FIG. 2 correspond fully to the model presented hereinabove and in FIG. 1 for applying the method according to the invention, and thus, to optimize the braking and stopping, corresponding measuring arrangements and a data processing unit are used, where applicable. The data processing unit will be described hereinbelow primarily with reference to FIG. 1.

To implement the method, it is appropriate to monitor a number of measured variables and to control the braking by means of the same.

According to the basic idea of the invention, the braking force/torque T1 effective from the shaft 2*a* is measured continuously or at predetermined intervals during the process of stopping the reel R, and according to the magnitude of the braking force/torque, a suitable braking force/torque T2 effective on the surface of the reel is determined, which is measured and adjusted to achieve the target value. Information on the magnitude of the braking force effective from the shaft is obtained in a normal manner from the braking of the centre-drive. To implement the measurements and necessary adjustments, the method utilizes a motor M1 in the centre-drive of the reel spool, motor M2 in the drive of the press roll and the loading device 4 of the press roll 3, from which the measuring results are fed in the data processing unit 8.

As a basis for the adjustment of the optimal braking forces and braking torque, especially the magnitude T1cond of the braking force/torque effective from the the shaft 2*a* of the reel spool is first measured, whereafter the variables measured thereby are utilized in the data processing unit 8 to determine an optimal magnitude (T2set) of the braking force/torque effective on the surface, which can be in a predetermined ratio to a corresponding variable effective from the shaft 2*a*. The optimal value of the braking force/torque effective on the surface, which is produced by the data processing unit 8, is utilized when control messages are given to the drive M2 of the shaft 3*a* of the press roll 3 and to the loading device 4.

The speed of rotation N1 of the reel spool and the speed of rotation N2 of the press roll 3 are also measured (N1cond and N2cond). When the diameter of the full reel R is known, the circumference of its perimeter as well as its peripheral speed (surface speed) are also known, and thus it is possible to determine the speed of rotation N2 at which the press roll 3 with a known circumference rotates without sliding against the reel R in a rolling contact. On the other hand, on the basis of the measured speeds of rotation N1 and N2, it is possible to determine the diameter of the reel R.

Controlled stopping of the reel R requires the act of preventing the creeping of the surface layers of the reel, i.e. the slackening of the reel at the same time when the aim is to minimize the stopping time. The act of preventing the slackening of the reel again requires a continuous active control of the braking forces and especially a control of the forces effective on the surface. Experiences have shown that it is essential in the control of slackening that during the entire process of stopping, the braking power effective on the surface is smaller than the braking power effective, from the shaft, or maximally equal to the same. By taking this into account it is possible to avoid especially the unnecessarily high braking forces effective on the surface, as is required by the solution presented in the utility model DE 29604401, which braking forces considerably increase the risk of damaging the surface layers.

In the method according to the invention, the braking force effective from the shaft 2*a* is utilized primarily to decelerate the rotation of the inner paper layers of the reel, and the braking force effective on the surface is utilized to decelerate the rotation of the outer cylinder or the "outer sleeve" of the reel, thus making the stopping take place quicker, but especially the braking force effective on the surface is utilized to prevent the slackening of the reel R. To prevent the slackening of the reel R, the friction force between the paper layers is taken into account and utilized in the method, and it is this idea in particular which forms a basis for the possibility to carry out the braking and stopping especially by using reasonable braking forces effective on the surface and devices producing the same.

To implement the basic idea of the invention, the braking power effective from the shaft 2*a* braking power equal thereto at maximum, effective on the surface, is distributed in the ratio of S=1:1 . . . 100:1. The braking power to be exerted on the rotating reel is directly proportional to its braking torque, and the ratio of the powers prevailing at a given time is equal to the ratio of the braking torques. The ratio S is adjusted in the beginning of the deceleration in such a way that the braking power effective on the surface is substantially equal to the braking power effective from the shaft. When the speed of rotation of the reel R is reduced, especially the braking force effective on the surface is simultaneously reduced in such a way that it eventually, when the reel travels in so-called crawling speed, is only a few per cent of its original value, e.g. 1 to 10% or only 1 to 5%.

When a reducing braking force effective on the surface is used, the ratio S of the braking powers is increased while the braking proceeds, but for the most of the braking time, for example 9/10 of the total braking time, it can be maintained in any of the aforementioned ranges, especially in the range of 1:1 . . . 100:1, in the range of 1:1 . . . 50:1, in the range of 5:4 . . . 100:1, in the range of 5.4 . . . 50:1, in the range of 3.2 . . . 10:1 or in the range of 3:2 . . . 50:1. The ratio S of the powers can remain in any of the aforementioned areas for the duration of the entire braking time, i.e. the time during which braking force/torque is exerted on the reel via the surface of the reel and the reeling shaft by means of corresponding brake devices.

The braking forces/torques effective both from the shaft and on the surface can be predetermined in such a way that a suitable ratio of the powers is fulfilled. Thus, it is possible to give set values T1set and T2set for the braking forces/torques effective from the shaft and on the surface on the reel. The set values are not necessarily the same during the stopping of the reel. Suitable ratios can be given to the control arrangement in curves, tables, etc., which describe the ratio and/or the absolute value of at least one torque as a function of a factor such as time or speed of rotation of the reel or variable changing during the stopping of the reel, depedent on the speed of rotation of the reel. Some possibilities for implementing the adjustment, as well as the possible control algorithms will be described hereinbelow.

The braking can be controlled for example as a function of the rotational energy, i.e. kinetic energy of the reel. The rotational energy of the reel is obtained from the equation $W_k = \frac{1}{2} J \omega^2$, in which J=the moment of inertia of the reel and ω=the angular speed of the reel. If the reel is presumed to be a homogeneous closed cylinder, its moment of inertia is $J = \frac{1}{2} mr^2$, in which m=the mass of the reel, and r=the radius of the reel. Hence, it can be seen that of the factors affecting the magnitude of the rotational energy, only the angular speed, which is proportional to the speed of rotation, changes during the rotation. It is an advantage of the use of the rotational energy that the mass of the reel as well as the diameter of the reel are taken into account therein, and the control method thus differs from the methods in which the stopping is controlled on the basis of the surface speed only.

FIG. 3 shows one example of the control of the braking of the reel implemented as a function of the rotational energy. The braking torque T is controlled in such a manner that when the rotational energy is reduced, the braking torque is increased. The rotational energy $W_k$ can be measured by measuring the speed of rotation of the reel and by multiplying its square with a constant term dependent on the dimensions and the mass of the particular reel to be decelerated. The reference value of FIG. 3 shows the rotational energy as a reference variable, but it can be replaced by an artificial variable which is directly proportional to the same and which can be of the type K·n2, in which n=the speed of rotation of the reel and K=a reel-specific constant dependent on the diameter/radius and the mass of the reel to be decelerated. In the drawing, the x-axis shows the rotational energy in decreasing. order, wherein it also describes the changes in the rotational energy during the deceleration of the reel. The numerical value 100% corresponds to the kinetic energy of the reel rotating at the production speed of the machine, i.e. the situation in the beginning of braking. The percentage portion of the momentary braking power of a given nominal power (100%) of the total braking power is shown on y-axis, and it is marked with the symbol T of the braking torque. The momentary braking power can exceed the nominal power for a while in the final stage of braking, i.e. the braking power is over 100%.

The braking torque moment T is a sum of the braking torque values acting on the reel from the shaft and through the perimeter, i.e. the torque values can be distributed in a suitable ratio according to the invention. The roll 3 itself does not have to be decelerated, but it can be used for loading the surface of the reel R sufficiently. In the beginning, the loading of the press roll is greater than in the end. To control the braking, it is thus possible to feed a table in the automation system of the reel-up, in which table a given braking power corresponds to a given rotational energy. When the braking is started, one has to be aware of the mass and diameter of the reel so that the kinetic energy can be calculated on the basis of each momentary speed of rotation. In the beginning (area A) 50 to 70% of the kinetic energy of the reel is braked off with a 50 to 90% momentary power, i.e. the rotational energy is reduced without breaking the structure of the reel. In the area B braking from the value of 30 to 50% to the value of 0% is conducted efficiently so that time is saved, and the curve rises most steeply in the area B. In the area B the final braking can be performed with a constant power (curve part B1) or the power can be increased gradually until the reel is stopped (curve part B2). In the end, the total braking force can be over twofold or even threefold when compared to the initial value.

The ratio S of the braking powers changes during the operation in accordance with FIG. 3. The braking power effective through the perimeter, i.e. on the surface of the reel, is reduced into a small portion of the initial value, resulting in the increase of the ratio S during braking. The ratio remains especially in the range of 1:1 . . . 100:1, 1:1 . . . 50:1, 5:4 . . . 100:1, 5:4 . . . 50:1, 3:2 . . . 100:1 or 3:2 . . . 50:1 for the most of the braking time, especially at least 9/10 of the total braking time, or for the duration of the entire braking process.

The deceleration curve of FIG. 4, in turn, illustrates the speed of rotation or the surface speed of the reel as a function of time, i.e. the deceleration takes place faster in the final stage of the braking. In the beginning the deceleration occurs more slowly. On the outer perimeter the layers have the highest moment of inertia, and it is an aim to suitably reduce the kinetic energy of the outer layers of the reel, and only after a particular kinetic energy is attained, a more powerful deceleration is possible.

In the following, a number of situations that occur in connection with braking will be described when arrangements according to FIGS. 1 and 2 are utilized, and when the braking is controlled in accordance with the principle of FIG. 3.

If skidding occurs in the surface layers of the reel R when braking is conducted by means of the drive of the roll 3 (brake generator), the actual value T2cond of the braking torque effective on the surface is reduced, wherein the control arrangement of the data processing unit 8 reduces the reference value, i.e. the set value T2set in accordance with which the actual value T2cond of the braking torque produced by the press roll 3 is reduced by means of the motor M2 of the press roll 3, until the skidding discontinues. If the aforementioned actions are not sufficient for stopping the slackening, the set value T1set of the braking torque effective from the shaft 2*a* is also reduced in the above-described manner.

If a mechanical or a hydraulic brake is utilized for the braking effected via the surface, the actual value Ncond of the speed of rotation of the press roll 3 is monitored. If skidding occurs in the surface layers of the reel, the actual value N2cond of the speed of rotation is reduced, wherein the control arrangement of the data processing unit 8 reduces the reference value i.e the set value T2set, in accordance with which the actual value T2cond of the braking torque produced by the press roll 3 is reduced until the skidding discontinues. If the aforementioned actions are not sufficient for stopping the slackening, the set value T1set of the braking force effective from the shaft 2*a* is also reduced in the above-described manner.

The actual value Fcond of the loading force can also be measured, and on the basis of the set value Fset of the loading force, the loading force is adjusted, at which the roll 3 is loaded against the reel by means of the loading device 4. If skidding is detected in the surface layers, it can be stopped by increasing the loading force of the reel 3 temporarily.

For data processing unit 8 it is possible to produce control algorithms which utilize the values received from the measurements, such as the following control algorithm for determining the total amount of braking torque required for stopping at a give time (t)

$$T(t)=f(m,r,\mu,\ n),$$

in which

T(t)=a time-dependent control algorithm m=the mass of the machine reel (R)

r=the radius of the machine reel or a variable proportional thereto, such as the diameter, $\mu$=a parameter connected to the paper grade, especially a friction coefficient and n=the speed of rotation of the machine reel (R) or a variable proportional thereto, such as the angular speed, and/or a control algorithm for controlling the distribution of the braking power during the stopping process $$S(t)=\frac{T1\text{set}}{T2\text{set}}=f(x),$$

in which

S(t)=a time-dependent control algorithm for calculating the ratio in the range of 1:1 . . . 100:1 or in any other above-described areas, T1set=the set value of the braking torque effective on the reel from the reeling shaft (2)

T2set=the set value of the braking torque effective on the reel on the surface, x=a variable changing during time, such as the time (t) or the speed of rotation (n) of the reel.

As is mentioned in connection with the latter control algorithm, the ratio S for distributing the braking torques can be based not only on the variables obtained during the braking process, but also on the empirical quantities and their values obtained earlier, wherein the ratio can be changed in a simple manner as a function of the time used for braking. The empirical values, in turn, can originate from the paper machine or from a finishing device for paper in which the method is applied, as well as from other paper machines or finishing apparatus for paper in which the braking process follows the above-presented basic solutions.

The invention is not restricted solely to the embodiments presented hereinabove and shown in the drawings, but they can vary within the scope of the inventive idea presented in the appended claims.

What is claimed is:

1. A method for stopping a machine reel in a final stage of reeling a web comprising the steps of:

cutting the web when the machine reel has become full;

guiding the cut web on a new reeling shaft;

stopping the machine reel by means of braking forces exerted upon the reeling shaft of the machine reel and on a surface of the machine reel;

wherein the braking forces exerted upon the reeling shaft and on the surface of the reel are distributed in a ratio of from 1:1 to 100:1.

2. The method according to claim 1, wherein the braking forces are distributed in a ratio of from 1:1 to 50:1.

3. The method according to claim 2, wherein the braking forces are distributed in a ratio from 1:1 to 10:1.

4. The method according to claim 3, wherein the braking forces are distributed in one of the following ranges: from 5:4 to 10:1; from 3:2 to 10:1; from 1:1 to 5:1 and from 3:2 to 5:1.

5. The method according to claim 1, herein the braking forces are distributed in a ratio of from 5:4 to 100:1.

6. The method according to claim 5, wherein the braking forces are distributed in a ratio of from 5:4 to 50:1.

7. The method according to claim 5, wherein the braking forces are distributed in a ratio of from 3:2 to 100:1.

8. The method according to claim 7, wherein the braking forces are distributed in a ratio of from 3:2 to 50:1.

9. The method according to claim 1, wherein said ratio between the braking forces is maintained for at least 9/10 of a total braking time.

10. The method according to claim 1, further comprising the step of changing said ratio between said braking forces during a time of application of said braking forces.

11. The method according to claim 10, wherein the braking force exerted on the surface of the machine reel is reduced from an initial value selected at a start of said time of application as the speed of rotation of the machine reel decreases.

12. The method according to claims 1, further comprising the step of using a control algorithm for determining a total magnitude of braking torque required for stopping, wherein the formula for said algorithm is:

$$T(t)=f(m, r, \mu, n),$$

wherein

T(t)=is a time dependent control algorithm m=the mass of the machine reel r=the radius of the machine reel or a variable proportional thereto, such as diameter $\mu$=a parameter related to the paper grade such as a friction coefficient and n=the speed of rotation of the machine reel or a variable proportional thereto, such as the angular speed.

13. The method according to claim 1, further comprising the step of adjusting said braking forces based upon a rotational energy of the machine reel.

14. The method according to claim 13, wherein said braking forces are increased as the rotational energy is reduced.

15. The method according to claim 1, further comprising the steps of measuring the braking force applied to said surface of the reel and determining if skidding is occurring between the layers of paper and, if such skidding is occurring, reducing said braking forces.

16. The method according to claim 1, wherein said force exerted on the surface of the machine reel is produced by loading said machine reel with a press roll.

17. The method according to claim 16, further comprising the steps of measuring the force exerted at the nip defined between the press roll and the surface of the machine reel and adjusting the load applied by said press roll based on said measured force exerted at the nip.

18. The method according to claim 16, further comprising coupling a loading device to the press roll for attaining the force exerted on the surface of the roll.

19. The method according to claim 16, wherein the press roll is a fixed position roll and wherein to attain the force exerted on the surface of the machine roll, the machine roll is loaded by a loading device against the press roll.

20. The method according to claim 16, wherein a separate press device is used, which before cutting the web is placed in contact with the machine reel at a point which is closer to the entrance point of the web on the reel than the press roll.

21. The method according to claim 1, further comprising the step of using a control algorithm for controlling the distribution of the braking power during the stopping process wherein the formula for said algorithm is:

$$S(t)=\mathrm{T1set}/\mathrm{T2set}=f(x),$$

wherein

S(t)=a time dependent control algorithm in the range of from 1:1 to 100:1

T1set=the set value of the braking torque effective on the reel on the reel from the reeling shaft T2set=the set value of the braking torque effective on the reel surface x=a variable changing during time, such as the time (t) or the speed of rotation (n) of the reel.

* * * * *